US011214072B2

(12) United States Patent
Tanabe et al.

(10) Patent No.: US 11,214,072 B2
(45) Date of Patent: Jan. 4, 2022

(54) INKJET RECORDING APPARATUS INCLUDING PIVOT MEMBER PROVIDED IN STORAGE CHAMBER OF TANK AND HAVING FIRST PROTRUSION AND SECOND PROTRUSION

(71) Applicant: BROTHER KOGYO KABUSHIKI KAISHA, Nagoya (JP)

(72) Inventors: Yuma Tanabe, Nagoya (JP); Akinari Ishibe, Okazaki (JP); Masatake Sato, Nagoya (JP); Hiroshi Taira, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/048,447

(22) Filed: Jul. 30, 2018

(65) Prior Publication Data

US 2019/0030910 A1 Jan. 31, 2019

(30) Foreign Application Priority Data

Jul. 31, 2017 (JP) ..... JP2017-148523

(51) Int. Cl.
*B41J 2/175* (2006.01)
*B41J 29/13* (2006.01)
*B41J 29/02* (2006.01)

(52) U.S. Cl.
CPC ..... *B41J 2/17566* (2013.01); *B41J 2/1752* (2013.01); *B41J 2/1753* (2013.01); (Continued)

(58) Field of Classification Search
CPC ... B41J 2/17553; B41J 2/17513; B41J 2/1752
See application file for complete search history.

(56) References Cited

U.S. PATENT DOCUMENTS 6,378,971 B1 4/2002 Tamura et al.
8,109,615 B2 * 2/2012 Kanbe ..... B41J 2/17553 347/86

(Continued)

FOREIGN PATENT DOCUMENTS

EP 2 165 837 A1 3/2010
JP 2001-270133 A 10/2001

(Continued)

OTHER PUBLICATIONS

Office Action (Notice of Reasons for Refusal) issued in corresponding Japanese Patent Application No. 2017-148523, dated Jun. 1, 2021.

*Primary Examiner* — Lam S Nguyen
(74) *Attorney, Agent, or Firm* — Merchant & Gould P.C.

(57) ABSTRACT

An inkjet recording apparatus includes a tank, a pivot member and a first surface. The tank has a storage chamber configured to store a liquid therein. The pivot member is disposed in the storage chamber. The pivot member is configured to pivotally move about an axis extending in an axial direction in a case where a level of a liquid surface of the liquid becomes equal to a predetermined liquid level. The pivot member includes a float and a first protrusion. The float has a specific gravity smaller than that of the liquid. The first protrusion protrudes toward the first surface. The first protrusion and the first surface provide a gap therebetween. The first protrusion is at a position in contact with the liquid in a state where the level of the liquid surface of the liquid is at the predetermined liquid level.

12 Claims, 9 Drawing Sheets

(52) U.S. Cl.
CPC ..... *B41J 2/17523* (2013.01); *B41J 2/17546* (2013.01); *B41J 2/17553* (2013.01); *B41J 29/02* (2013.01); *B41J 29/13* (2013.01); *B41J 2002/17576* (2013.01)

(56) References Cited

U.S. PATENT DOCUMENTS

| | | | | |
|---|---|---|---|---|
| 2002/0024543 | A1 | 2/2002 | Kimura et al. | |
| 2005/0068389 | A1* | 3/2005 | Katayama ..... | B41J 2/17513 347/86 |
| 2005/0162490 | A1 | 7/2005 | Katayama et al. | |
| 2006/0007283 | A1 | 1/2006 | Sacco, Jr. et al. | |
| 2006/0164482 | A1 | 7/2006 | Katayama et al. | |
| 2008/0204488 | A1 | 8/2008 | Usui | |
| 2008/0239033 | A1 | 10/2008 | Hattori | |
| 2016/0279952 | A1 | 9/2016 | Wang | |
| 2017/0151803 | A1 | 6/2017 | Yoshii et al. | |

FOREIGN PATENT DOCUMENTS

| | | | |
|---|---|---|---|
| JP | 2001-287380 | A | 10/2001 |
| JP | 2005-262564 | A | 9/2005 |
| JP | 2008-213162 | A | 9/2008 |
| JP | 2008-254194 | A | 10/2008 |
| JP | 2010-69757 | A | 4/2010 |
| JP | 2012-206372 | A | 10/2012 |
| JP | 2016-185650 | A | 10/2016 |
| JP | 2016-185659 | A | 10/2016 |
| JP | 2017-94634 | A | 6/2017 |

* cited by examiner

INKJET RECORDING APPARATUS INCLUDING PIVOT MEMBER PROVIDED IN STORAGE CHAMBER OF TANK AND HAVING FIRST PROTRUSION AND SECOND PROTRUSION

CROSS REFERENCE TO RELATED APPLICATION

This application claims priority from Japanese Patent Application No. 2017-148523 filed Jul. 31, 2017. The entire content of the priority application is incorporated herein by reference.

TECHNICAL FIELD

The present disclosure relates to an inkjet recording apparatus including a liquid chamber configured to store liquid therein, the inkjet recording apparatus being capable of detecting a residual amount of the liquid stored in the liquid chamber.

BACKGROUND

There is conventionally known an inkjet recording apparatus including an ink chamber configured to store ink therein and a head having nozzles through which ink supplied from the ink chamber is ejected.

One such conventional inkjet recoding apparatus has a configuration for detecting a residual amount of ink stored in the ink chamber. For example, the inkjet recording apparatus includes a pivot member pivotally supported in the ink chamber. The pivot member includes a float having a specific gravity smaller than that of the ink stored in the ink chamber, and a detected portion that is configured to be detected by a sensor. In a case where a liquid level of the ink stored in the ink chamber is higher than a predetermined height, the pivot member is positioned at a predetermined position due to buoyancy acting on the float. In a case where the liquid level of the ink stored in the ink chamber is equal to or lower than the predetermined height, the pivot member is pivotally moved by gravity. The pivotal movement of the pivot member moves the detected portion. The movement of the detected portion is detected by the sensor. In this way, the residual amount of the ink stored in the ink chamber is detected.

SUMMARY

As the residual amount of the ink stored in the ink chamber is reduced and the liquid level of the ink is lowered, at least a part of the detected portion is positioned upward relative to the liquid level. At this time, due to surface tension of ink remaining between the detected portion and a surface of the ink chamber (for example, a surface defining the ink chamber), the detected portion may adhere to this surface while ink is retained between the detected portion and the surface. When such adhesion between the detected portion and the surface occurs, pivotal movement of the pivot member may be hindered. This may prevent the residual amount of the ink stored in the ink chamber from being detected accurately.

In view of the foregoing, it is an object of the disclosure to provide an inkjet recording apparatus with a structure capable of reducing hindrance to pivotal movement of the pivot member for detecting a residual amount of liquid stored in a liquid chamber.

In order to attain the above and other objects, according to one aspect, the disclosure provides an inkjet recording apparatus including a tank, a recording portion, a pivot member, a detecting portion and a first surface. The tank has a storage chamber configured to store a liquid therein. The recording portion includes a recording head. The recording portion is configured to eject the liquid supplied from the storage chamber. The pivot member is disposed in the storage chamber. The pivot member is configured to pivotally move about an axis extending in an axial direction in a case where a level of a liquid surface of the liquid stored in the storage chamber becomes equal to a predetermined liquid level. The pivot member includes a float, a detected portion and a first protrusion. The float has a specific gravity smaller than that of the liquid stored in the storage chamber. The detected portion extends from the float in a direction crossing the axial direction. The detected portion is configured to be detected by the detecting portion. The detecting portion is configured to detect pivotal movement of the pivot member. The first surface is disposed in the storage chamber. The first surface crosses the axial direction. The first protrusion protrudes in the axial direction toward the first surface. The first protrusion and the first surface provide a gap therebetween in the axial direction. The first protrusion is at a position in contact with the liquid stored in the storage chamber in a state where the level of the liquid surface of the liquid stored in the storage chamber is at the predetermined liquid level.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1A:
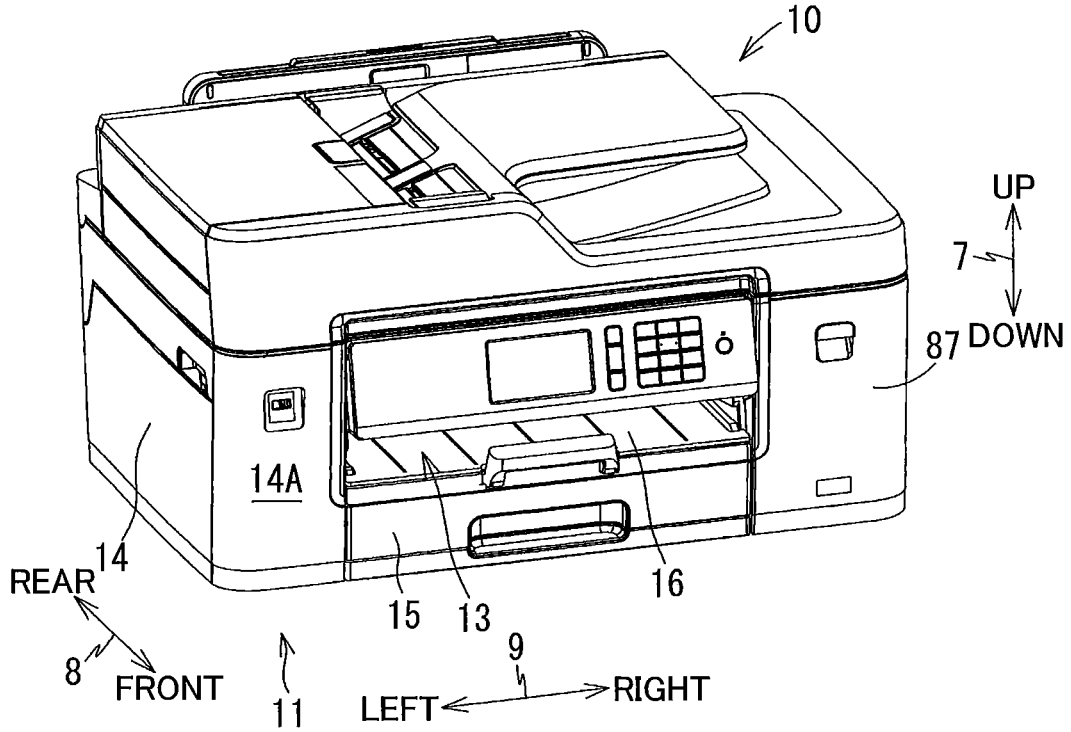
FIG. 1A is a perspective view of a multifunction peripheral 10 according to one embodiment of the present disclosure, in which a cover 87 of the multifunction peripheral 10 is at a closed position.

A multifunction peripheral 10 as an example of an inkjet recording apparatus according to one embodiment will be described with reference to the accompanying drawings, wherein like parts and components are designated by the same reference numerals to avoid duplicating description.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will also be referred to as an "operable posture". Specifically, an up-down direction 7 of the multifunction peripheral 10 will be defined based on the operable posture of the multifunction peripheral 10. A front-rear direction 8 will be defined assuming that a surface of the multifunction peripheral 10 formed with an opening 13 is a front surface 14A of the multifunction peripheral 10 in the operable posture. A left-right direction 9 will be defined based on an assumption that the multifunction peripheral 10 in the operable posture is viewed from its front side. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

<Overall Structure of Multifunction Peripheral 10>

Figure 1B:
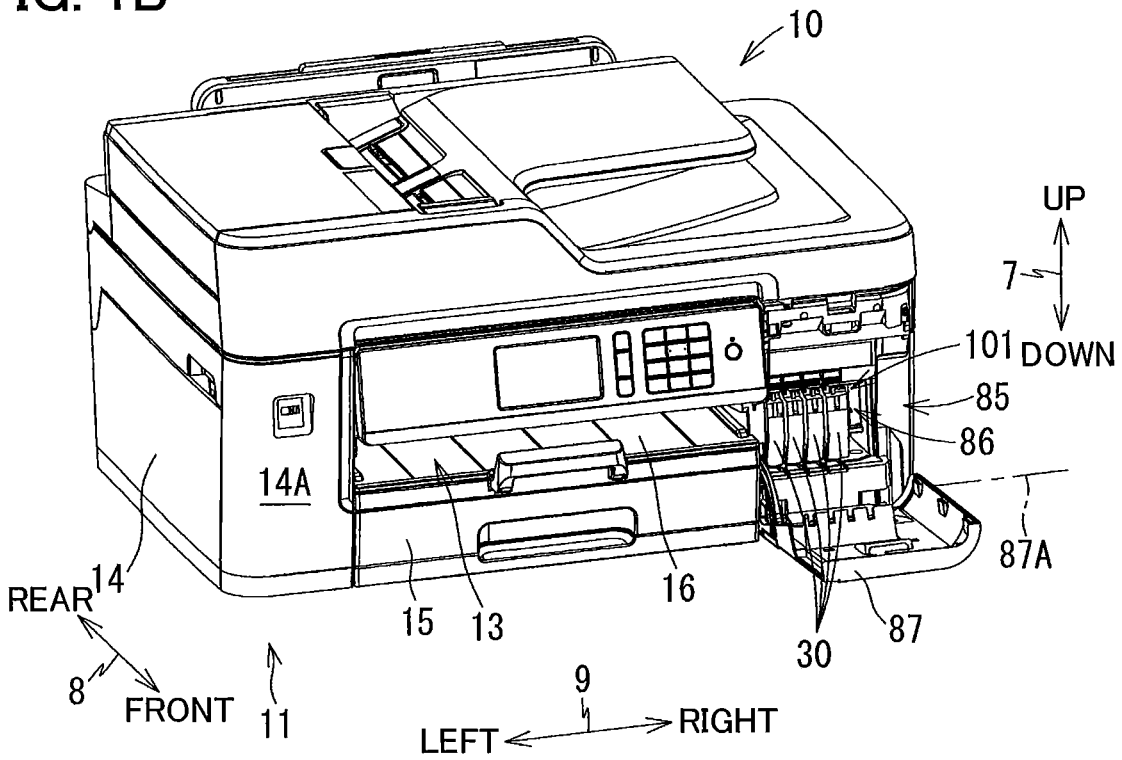
FIG. 1B is a perspective view of the multifunction peripheral 10 according to the embodiment, in which the cover 87 is at an open position.

As illustrated in FIGS. 1A and 1B, the multifunction peripheral 10 has a substantially rectangular parallelepiped shape. The multifunction peripheral 10 has a lower portion at which a printer portion 11 is provided. The printer portion 11 is configured to record an image on a sheet of paper 12 (see FIG. 2) based on an inkjet recording method. The printer portion 11 includes a casing 14 whose front surface 14A is formed with the opening 13.

Figure 2:
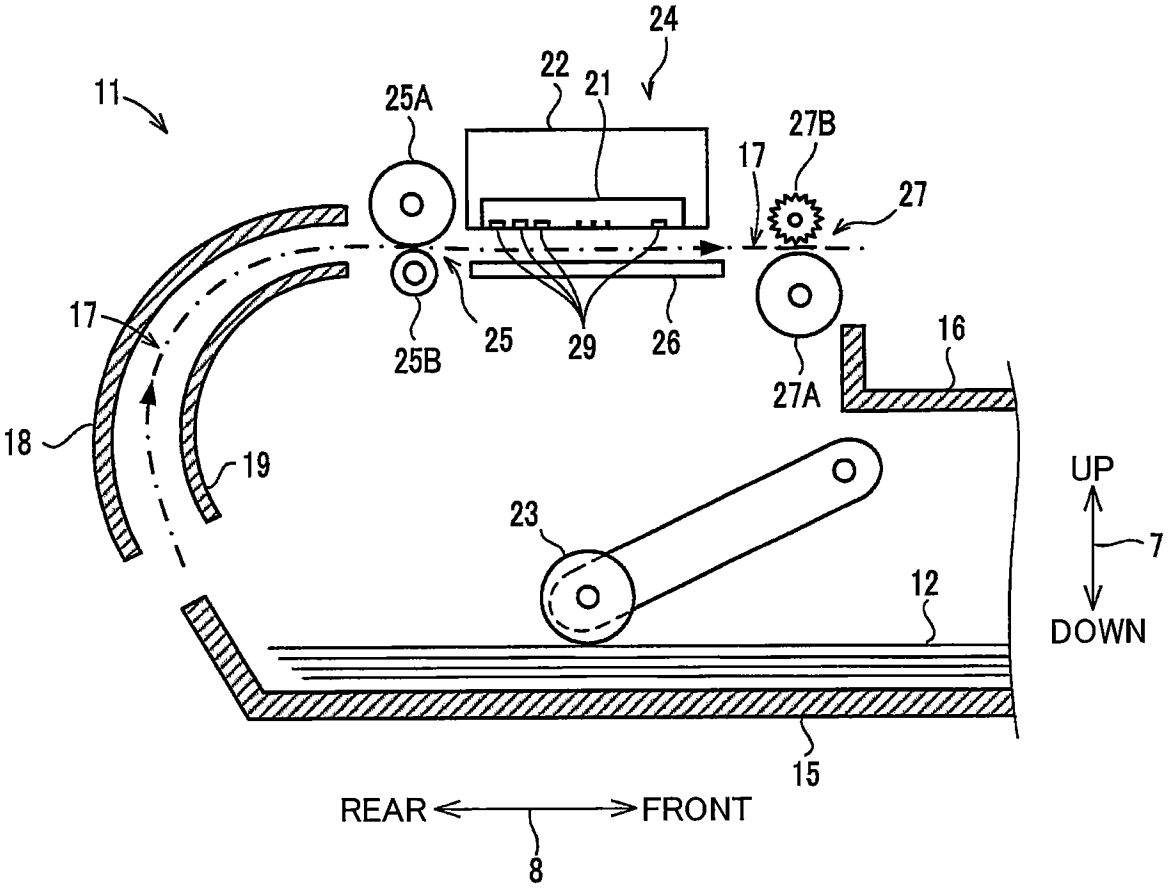
FIG. 2 is a vertical cross-sectional view schematically illustrating an internal structure of a printer portion 11 of the multifunction peripheral 10 according to the embodiment.

As illustrated in FIG. 2, within the casing 14, provided are a feed roller 23, a feed tray 15, a discharge tray 16, a conveying roller pair 25, a recording portion 24, a discharge roller pair 27, a platen 26, and a case 101 (see FIG. 1B). The multifunction peripheral 10 has various functions such as a facsimile function and a printing function. The state illustrated in FIGS. 1A and 1B is the operable posture of the multifunction peripheral 10.

<Feed Tray 15, Discharge Tray 16, Feed Roller 23>

As illustrated in FIGS. 1A and 1B, the feed tray 15 is configured to be inserted into and removed from the casing 14 through the opening 13 along the front-rear direction 8 by a user. The opening 13 is positioned at a center portion of the front surface 14A of the casing 14 in the left-right direction 9. As illustrated in FIG. 2, the feed tray 15 is configured to support a plurality of sheets 12 in a stacked state.

The discharge tray 16 is positioned above the feed tray 15. The discharge tray 16 is configured to support the sheets 12 discharged by the discharge roller pair 27.

The feed roller 23 is configured to feed each of the sheets 12 supported on the feed tray 15 toward a conveying path 17. The feed roller 23 is configured to be driven by a feed motor (not illustrated).

<Conveying Path 17>

As illustrated in FIG. 2, the conveying path 17 is a space partially defined by an outer guide member 18 and an inner guide member 19 facing each other at a predetermined interval inside the printer portion 11. The conveying path 17 extends rearward from a rear end portion of the feed tray 15, and then, U-turns frontward while extending upward at a rear portion of the printer portion 11, and passes through a space between the recording portion 24 and the platen 26, and reaches the discharge tray 16. A part of the conveying path 17 positioned between the conveying roller pair 25 and the discharge roller pair 27 is provided at a substantially center portion of the multifunction peripheral 10 in the left-right direction 9, and extends in the front-rear direction 8. A conveying direction of the sheet 12 in the conveying path 17 is indicated by a dashed-dotted arrow in FIG. 2.

<Conveying Roller Pair 25>

As illustrated in FIG. 2, the conveying roller pair 25 is disposed at the conveying path 17. The conveying roller pair 25 includes a conveying roller 25A and a pinch roller 25B opposed to each other. The conveying roller 25A is configured to be driven by a conveying motor (not illustrated). The pinch roller 25B is configured to be rotated in accordance with rotation of the conveying roller 25A. When the conveying roller 25A is rotated forward in response to forward rotation of the conveying motor, the sheet 12 is conveyed in the conveying direction (i.e. frontward direction) while nipped between the conveying roller 25A and the pinch roller 25B.

<Discharge Roller Pair 27>

As illustrated in FIG. 2, the discharge roller pair 27 is disposed at the conveying path 17 at a position downstream relative to the conveying roller pair 25 in the conveying direction. The discharge roller pair 27 includes a discharge roller 27A and a spur roller 27B opposed to each other. The discharge roller 27A is configured to be driven by the conveying motor (not illustrated). The spur roller 27B is configured to be rotated in accordance with rotation of the discharge roller 27A. When the discharge roller 27A is rotated forward in response to the forward rotation of the conveying motor, the sheet 12 is conveyed in the conveying direction (i.e. frontward direction) while nipped between the discharge roller 27A and the spur roller 27B.

<Recording Portion 24>

As illustrated in FIG. 2, the recording portion 24 is disposed at the conveying path 17 at a position between the conveying roller pair 25 and the discharge roller pair 27. The recording portion 24 is arranged so as to be opposed to the platen 26 in the up-down direction 7, with the conveying path 17 interposed between the recording portion 24 and the platen 26. The recording portion 24 is positioned above the conveying path 17, and the platen 26 is positioned below the conveying path 17. The recording portion 24 includes a carriage 22 and a recording head 21.

Figure 3:
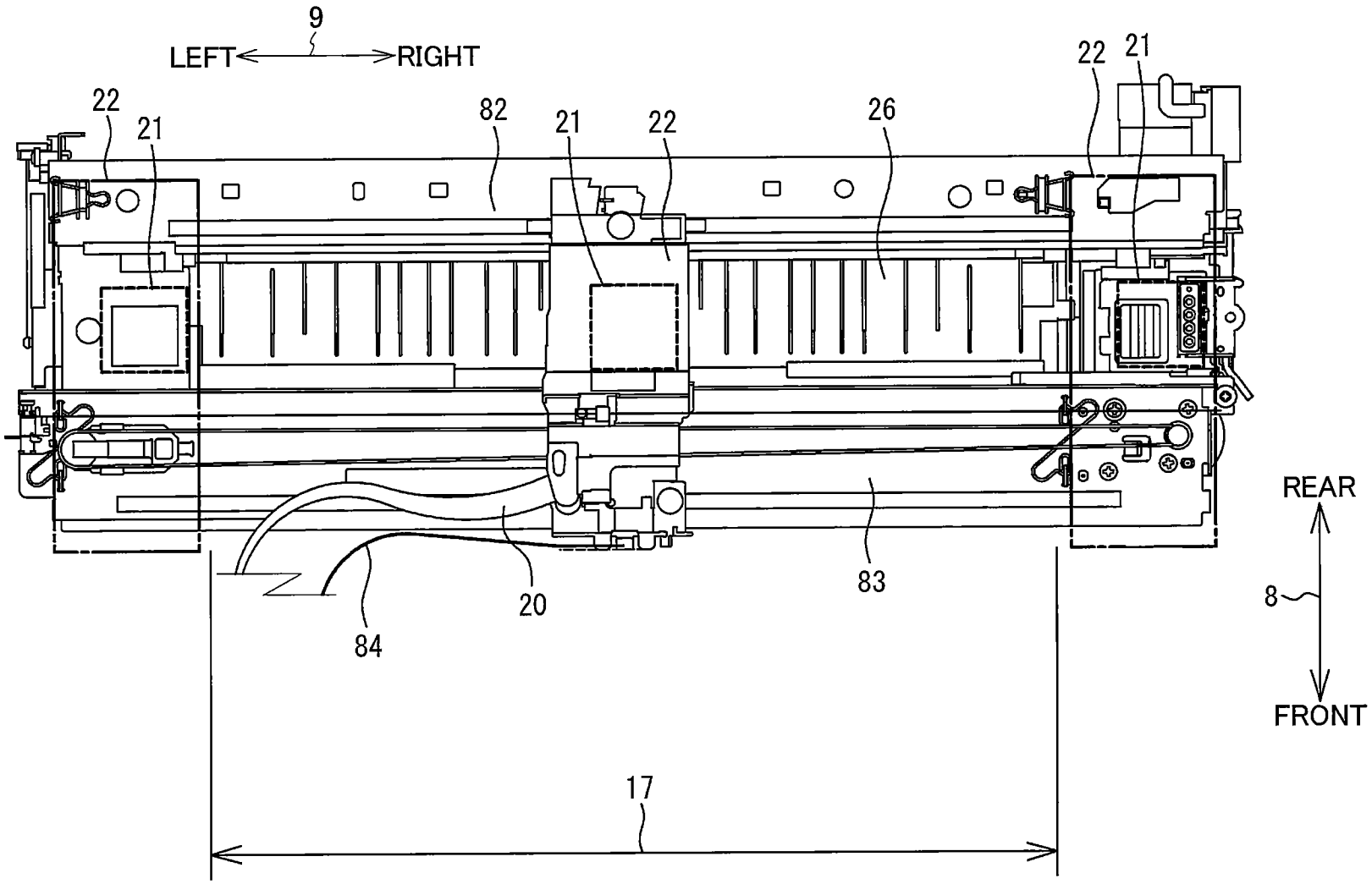
FIG. 3 is a plan view illustrating arrangement of a carriage 22 and a platen 26 of the multifunction peripheral 10 according to the embodiment.

As illustrated in FIG. 3, the carriage 22 is supported by guide rails 82 and 83. The guide rails 82 and 83 extend in the left-right direction 9 and spaced apart from each other in the front-rear direction 8. The guide rails 82 and 83 are supported by a frame (not illustrated) of the printer portion 11. The carriage 22 is connected to a known belt mechanism provided at the guide rail 83. The belt mechanism is configured to be driven by a carriage driving motor (not illustrated). The carriage 22 connected to the belt mechanism is configured to reciprocatingly move in the left-right direction 9 in response to driving of the carriage driving motor. The carriage 22 is configured to move further leftward and rightward from the conveying path 17, as indicated by long and short dashed lines in FIG. 3.

Further, as illustrated in FIG. 3, a bundle of ink tubes 20 and a flexible flat cable 84 extend from the carriage 22.

The ink tubes 20 connect a tank 103 (see FIGS. 4 and 5) to the recording head 21. Each of the ink tubes 20 is configured to supply ink (an example of liquid) stored in a corresponding ink cartridge 30 (an example of a cartridge, see FIGS. 1B and 4) attached to the case 101 to the recording head 21 through the tank 103. In the present embodiment, four ink cartridges 30 are attachable to the case 101. Accordingly, four ink tubes 20 are provided in one-to-one correspondence with the four ink cartridges 30 so that ink of four colors (black, magenta, cyan, and yellow) stored in the respective four ink cartridges 30 can flow through the corresponding ink tubes 20. These ink tubes 20 are bundled and connected to the carriage 22.

The flexible flat cable 84 is configured to electrically connect a main board (not illustrated) to the recording head 21. A controller (not illustrated) is mounted on the main board. The controller includes a CPU, a RAM, a ROM, and the like. The controller is configured to control operations of the multifunction peripheral 10. The flexible flat cable 84 is configured to transmit control signals outputted from the controller to the recording head 21.

As illustrated in FIG. 2, the recording head 21 is mounted on the carriage 22. A plurality of nozzles 29 are provided on a lower surface (i.e. a surface facing the platen 26) of the recording head 21. The recording head 21 is supplied with ink from each ink cartridge 30 (see FIG. 4). The recording head 21 is configured to eject ink through each nozzle 29 as minute ink droplets. The ink droplets are ejected through the nozzle 29 toward the platen 26 while the carriage 22 reciprocatingly moves in the left-right direction 9. Hence, the ink droplets are landed onto the sheet 12 conveyed by the conveying roller pair 25 and supported on the platen 26, whereby an image is recorded on the sheet 12.

<Platen 26>

As illustrated in FIG. 2, the platen 26 is disposed at the conveying path 17 at a position between the conveying roller pair 25 and the discharge roller pair 27. The platen 26 is arranged so as to be opposed to the recording portion 24 in the up-down direction 7, with the conveying path 17 interposed between the platen 26 and the recording portion 24. The platen 26 supports the sheet 12 conveyed by the conveying roller pair 25 from below.

<Cover 87>

As illustrated in FIG. 1B, an opening 85 is formed in the front surface 14A of the casing 14 at a right end portion thereof. An accommodation space 86 capable of accommodating the case 101 and the tank 103 therein is formed rearward of the opening 85. A cover 87 is attached to the casing 14 so as to cover the opening 85. The cover 87 is configured to be pivotally movable about a pivot axis 87A (pivot center) extending in the left-right direction 9 between a closed position (a position illustrated in FIG. 1A) for closing the opening 85 and an open position (a position illustrated in FIG. 1B) for exposing the opening 85.

<Case 101>

Figure 4:
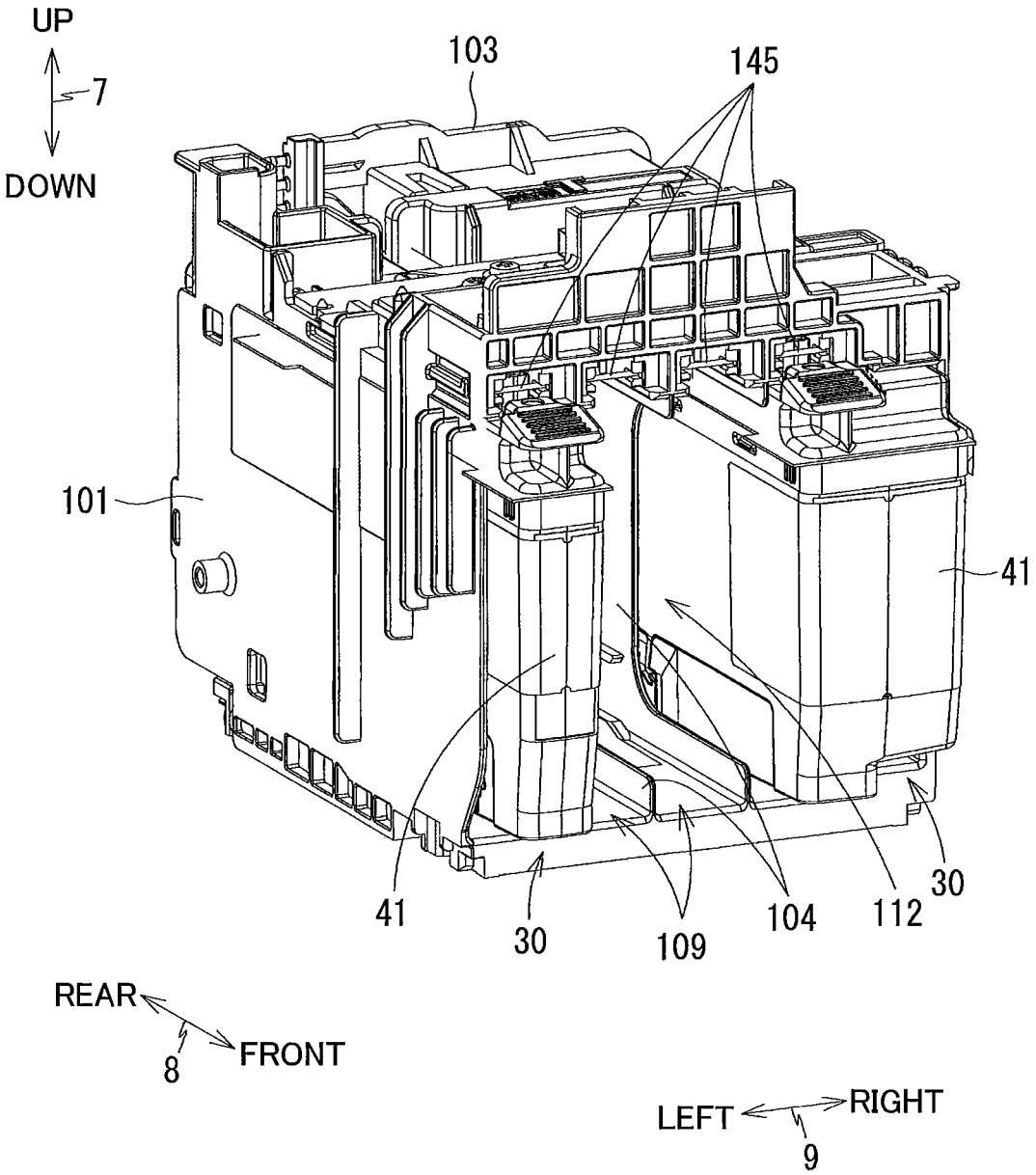
FIG. 4 is a perspective view of a case 101 and a tank 103 of the multifunction peripheral 10 according to the embodiment, as viewed from an upper-front left side thereof.
Figure 5:
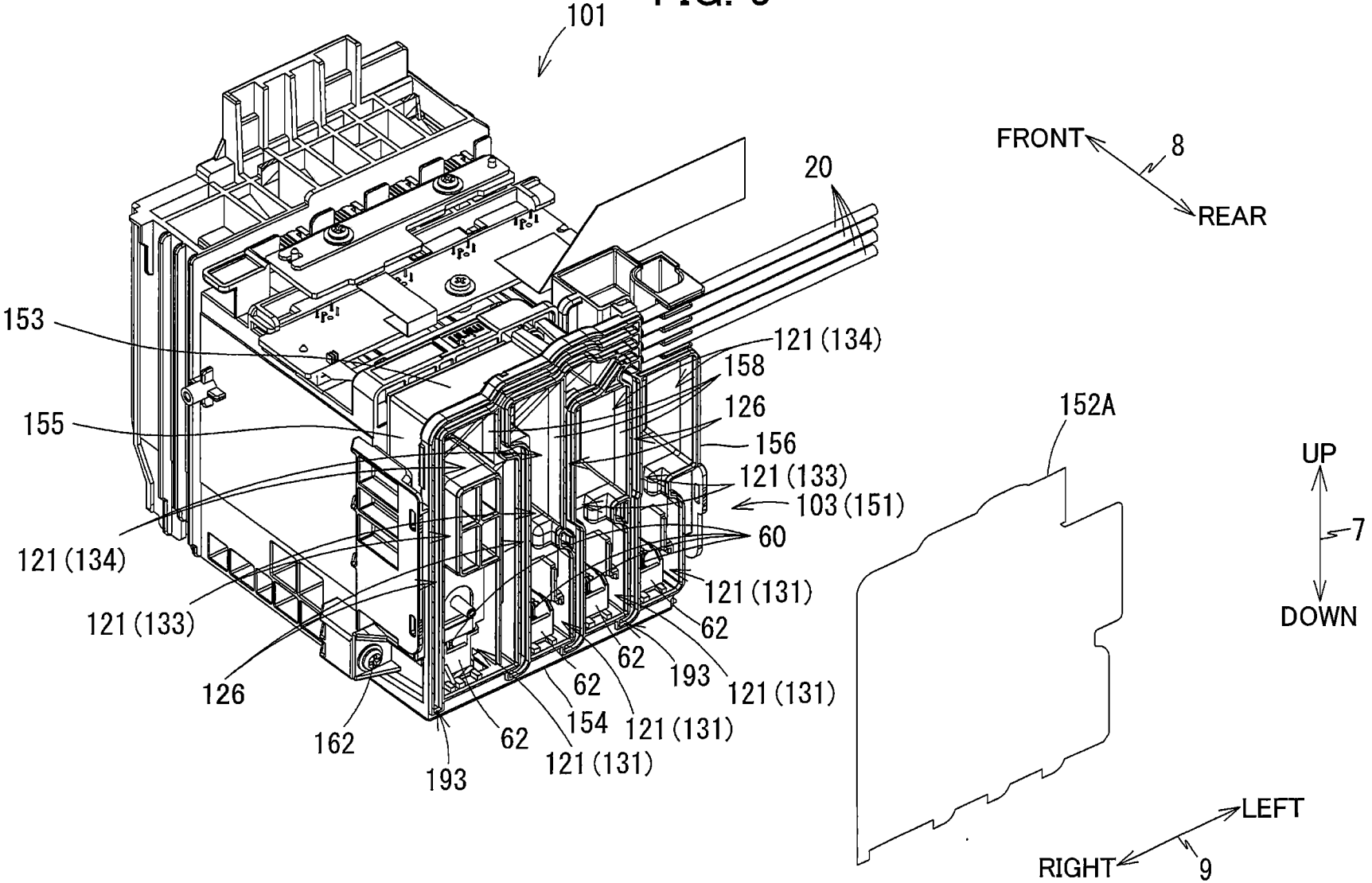
FIG. 5 is a perspective view of the case 101 and the tank 103 according to the embodiment, as viewed from an upper-rear right side thereof.

As illustrated in FIGS. 4 and 5, the case 101 has a box-like shape defining an internal space therein. The case 101 has an inner top surface defining a top end of the internal space, an inner bottom surface defining a bottom end of the internal space, an inner rear surface connecting the top end and the bottom end, and an opening 112 formed at a position opposing the inner rear surface in the front-rear direction 8. The opening 112 can be exposed to the front surface 14A (see FIGS. 1A and 1B) of the casing 14 that is a surface that the user faces when the multifunction peripheral 10 is used.

The ink cartridges 30 can be inserted into and removed from the case 101 through the opening 85 (see FIG. 1B) of the casing 14 and the opening 112 of the case 101. As illustrated in FIG. 4, the inner bottom surface of the case 101 is formed with four guide grooves 109. Movements of the ink cartridges 30 in the front-rear direction 8 are guided by the guide grooves 109 as lower end portions of the ink cartridges 30 are inserted into the guide grooves 109.

As illustrated in FIG. 4, the case 101 has three plates 104 that partition the internal space of the case 101 into four individual spaces each elongated in the up-down direction 7. Each of the four spaces partitioned by the plates 104 is configured to receive one of the four ink cartridges 30. In the present embodiment, of the four spaces, the rightmost space is larger in dimension in the left-right direction 9 than the other three spaces. The ink cartridge 30 storing black ink is accommodated in the rightmost space, and the ink cartridges 30 respectively storing magenta ink, cyan ink, and yellow ink are accommodated in the remaining three spaces, respectively. Incidentally, the sizes of the respective spaces, the sizes of the respective ink cartridges 30 accommodated in the respective spaces, and the colors of ink stored in the respective ink cartridges 30 accommodated in the respective spaces are not limited to those described above.

<Lock Shaft 145>

As illustrated in FIG. 4, a lock shaft 145 extends in the left-right direction 9 at a position in the vicinity of the inner top surface of the case 101 and in the vicinity of the opening 112 of the case 101. The lock shaft 145 is a bar-like member extending in the left-right direction 9. The lock shaft 145 is, for example, a metal column. The lock shaft 145 has a left end fixed to a left end wall of the case 101 defining a left end of the case 101, and a right end fixed to a right end wall of the case 101 defining a right end of the case 101. The lock shaft 145 extends in the left-right direction 9 over the four spaces of the case 101 in which the four ink cartridges 30 can be respectively accommodated.

Figure 8:
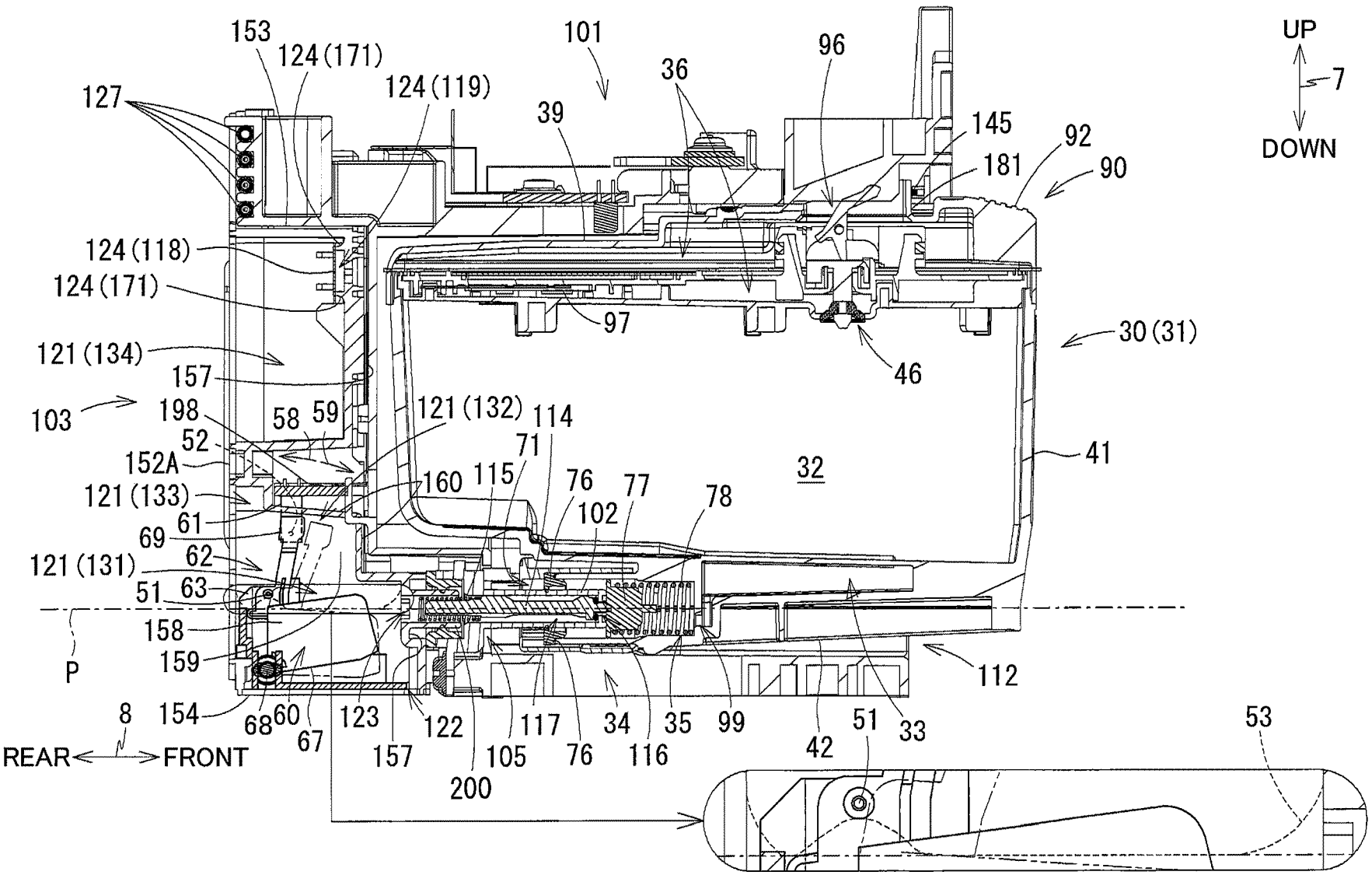
FIG. 8 is a vertical cross-sectional view illustrating a state where an ink cartridge 30 attached to the case 101 is connected to the tank 103 according to the embodiment.

The lock shaft 145 is configured to retain each of the ink cartridges 30 attached to the case 101 at an attached position. As illustrated in FIG. 8, in a state where the ink cartridges 30 are attached to the case 101, the ink cartridges 30 are respectively engaged with the lock shaft 145. As a result, the lock shaft 145 retains each ink cartridge 30 in the case 101 against an urging force of a coil spring 78 of the ink cartridge 30 that pushes the ink cartridge 30 frontward.

<Tank 103>

Figure 7:
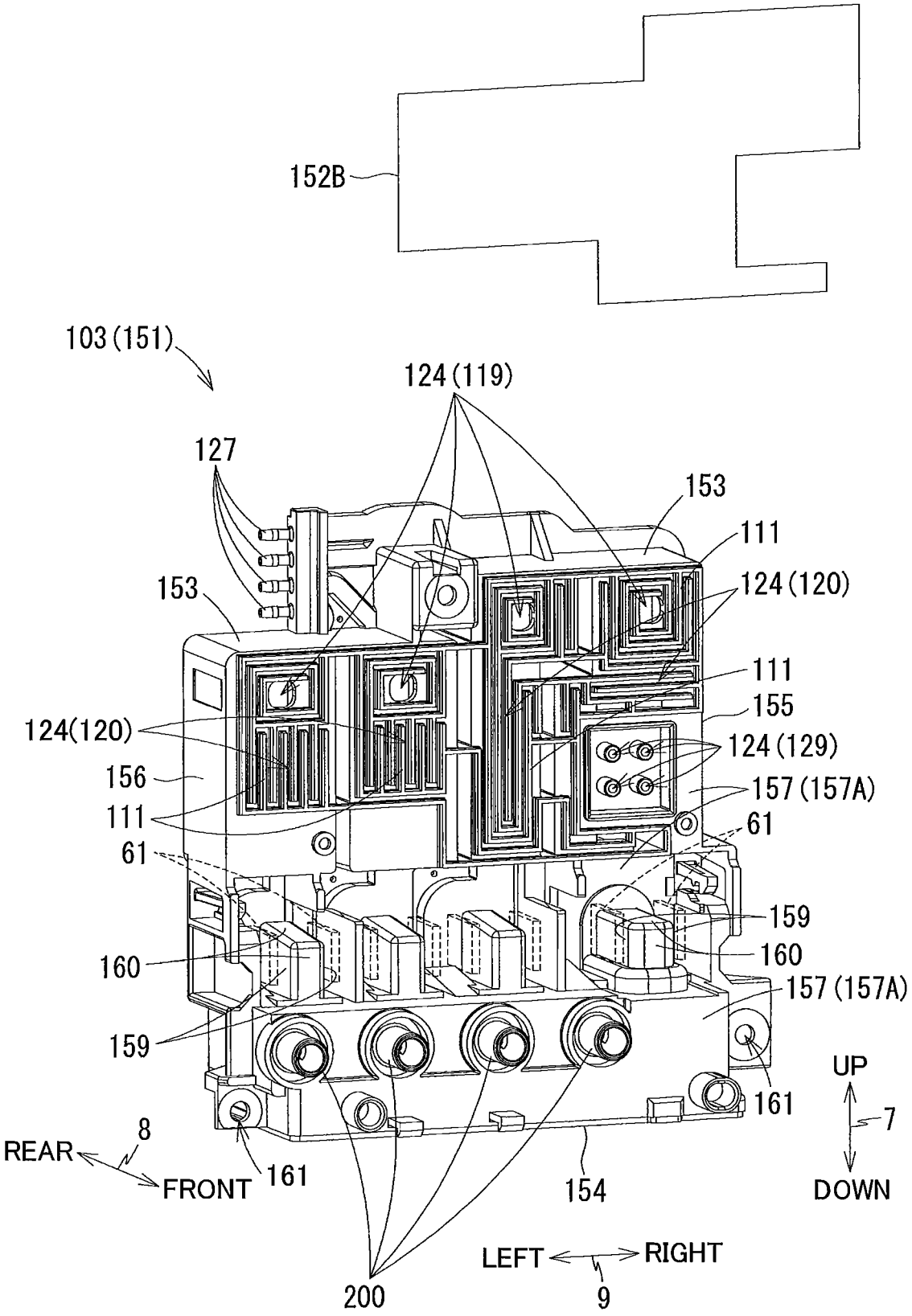
FIG. 7 is a perspective view of the tank 103 according to the embodiment as viewed from an upper-front left side thereof.

As illustrated in FIGS. 5 and 7, the tank 103 has a tank body 151, a film 152A, and a film 152B. The tank body 151 has a box-like shape. Within the tank body 151, four storage chambers 121 each for storing ink therein are provided. The film 152A is welded to a rear surface of the tank body 151. The film 152B is welded to a front surface of the tank body 151.

As illustrated in FIG. 7, the tank body 151 has two openings 161, one at a lower right end portion of the tank body 151 and the other at a lower left end portion of the tank body 151. The case 101 has two threaded-holes (not illustrated), one at a lower right end portion of a rear surface of the case 101 and the other at a lower left end portion of the rear surface of the case 101. As illustrated in FIG. 5, a screw 162 is screwed into each threaded-hole of the case 101 from its rear side through the opening 161, so that the tank 103 is fixed to the case 101. The tank 103 fixed to the case 101 is positioned rearward relative to the case 101 and the ink cartridge 30 attached to the case 101.

As illustrated in FIGS. 5 and 7, the tank body 151 has an upper wall 153, a lower wall 154, a right wall 155, a left wall 156, a front wall 157, three inner walls 158, four sets of a pair of side walls 159, and four connection walls 160.

The upper wall 153 extends in the front-rear direction 8 and the left-right direction 9, and defines top ends of the storage chambers 121. The lower wall 154 extends in the front-rear direction 8 and the left-right direction 9, and defines bottom ends of the storage chambers 121. The right wall 155 extends in the up-down direction 7 and the front-rear direction 8, and defines a right end of a rightmost storage chamber 121. The left wall 156 extends in the up-down direction 7 and the front-rear direction 8, and defines a left end of a leftmost storage chamber 121. The front wall 157 extends in the up-down direction 7 and the left-right direction 9, and defines front ends of the storage chambers 121. The tank body 151 defines all the ends of the storage chambers 121 other than rear ends of the storage chambers 121.

As illustrated in FIG. 5, the three inner walls 158 partition an internal space of the tank body 151 into four spaces to provide the four storage chambers 121. The four storage chambers 121 are provided in one-to-one correspondence with the four spaces of the case 101.

As illustrated in FIG. 7, the four sets of a pair of side walls 159 and the four connection walls 160 are provided in one-to-one correspondence with the four storage chambers 121. Each pair of side walls 159 protrudes frontward from the front wall 157. Portions of the front wall 157 where the four sets of a pair of side walls 159 protrude are positioned rearward relative to a remaining portion of the front wall 157. The side walls 159 in each pair are opposed to each other in the left-right direction 9.

Figure 9A:
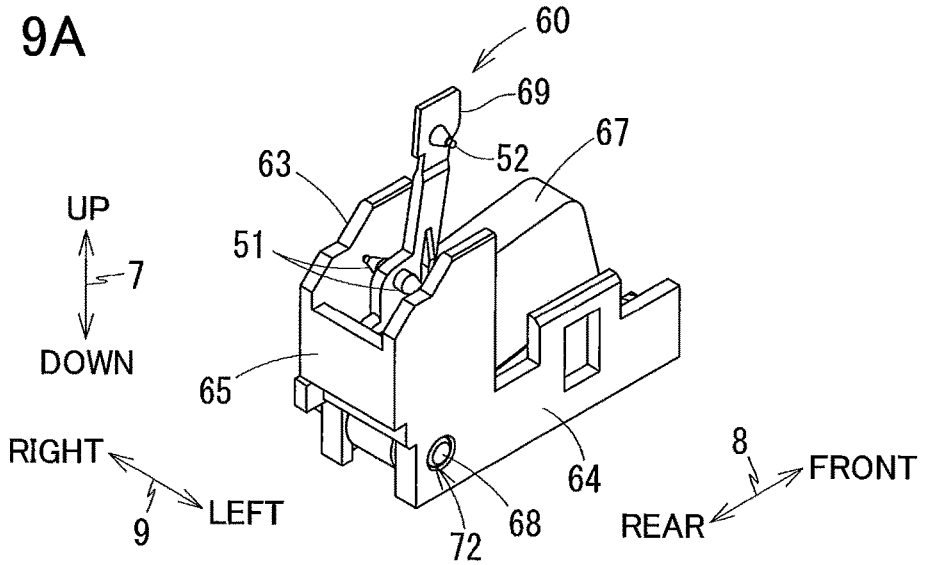
FIG. 9A is a perspective view of a pivot member 60 and a support member 62 provided in the tank 103 according to the embodiment.
Figure 9B:
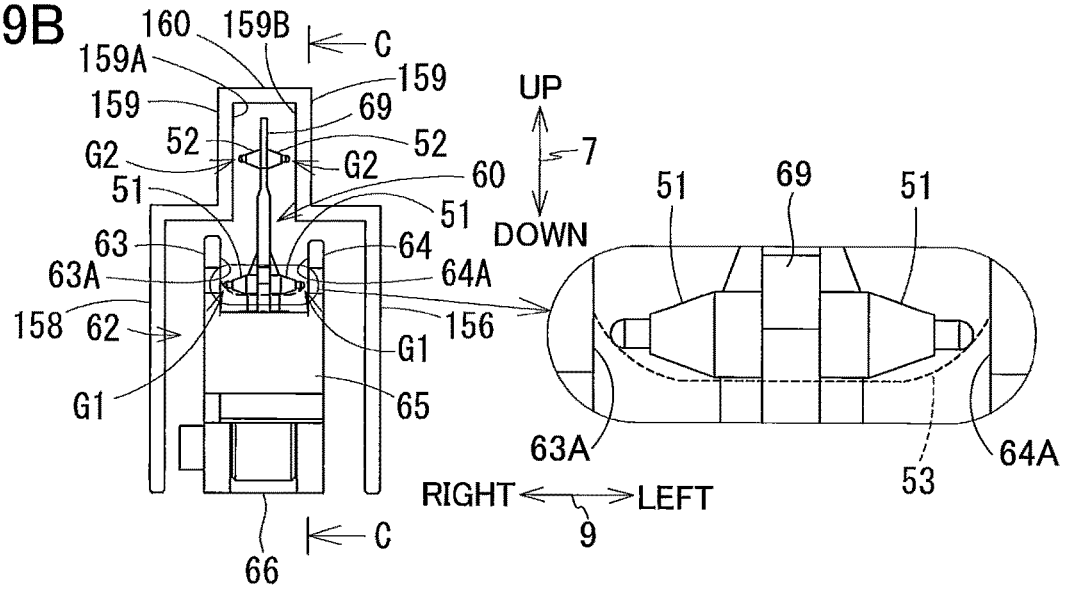
FIG. 9B is a rear view of the pivot member 60, the support member 62, and wall portions of the tank 103 according to the embodiment.

As illustrated in FIG. 9B, in each pair of side walls 159, a left surface 159A of one of the side walls 159 positioned rightward of the other of the side walls 159 (i.e. a right side wall 159) extends in the up-down direction 7 and the front-rear direction 8, and a right surface 159B of the other of the side walls 159 positioned leftward of the one of the side walls 159 (i.e. a left side wall 159) extends in the up-down direction 7 and the front-rear direction 8. The left surface 159A and the right surface 159B are opposed to each other in the left-right direction 9. The left surface 159A and the right surface 159B are each an example of a second surface.

Each connection wall 160 connects the left and right side walls 159 in each pair. A space defined by one set of a pair of side walls 159 and corresponding one of the connection walls 160 serves as a second portion 132 (described later, see FIG. 8) constituting a portion of the corresponding one of the storage chambers 121.

The film 152A illustrated in FIG. 5 is welded to the rear surface of the tank body 151. In other words, the film 152A is welded to a portion of the tank body 151 opposing the front wall 157 in the front-rear direction 8. The film 152A welded to the rear surface of the tank body 151 extends in the up-down direction 7 and the left-right direction 9, and defines rear ends of the storage chambers 121.

The film 152B illustrated in FIG. 7 is welded to protruding endfaces of ribs 111 formed on the front wall 157.

Next, the configuration of the storage chamber 121 will be described. Since the four storage chambers 121 have substantially the same configuration as one another, the configuration of the leftmost storage chamber 121 will be described in detail while description of the remaining three storage chambers 121 will be omitted.

As illustrated in FIGS. 5 and 8, the storage chamber 121 has a first portion 131, the second portion 132, a third portion 133, and a fourth portion 134.

The first portion 131 constitutes a lower portion of the storage chamber 121. The first portion 131 is defined by the front wall 157, the lower wall 154, the left wall 156, the inner wall 158, and the film 152A.

The second portion 132 constitutes a portion of the storage chamber 121 positioned upward relative to the first portion 131. That is, the second portion 132 is positioned upward relative to the first portion 131. The second portion 132 is defined by the pair of side walls 159 (specifically, the left surface 159A and the right surface 159B (see FIG. 9B)) and the connection wall 160. A lower end of the second portion 132 is in communication with an upper end of the first portion 131. The second portion 132 has a capacity smaller than that of the first portion 131.

The third portion 133 constitutes a portion of the storage chamber 121 positioned upward relative to the first portion 131 and rearward relative to the second portion 132. The third portion 133 is defined by the front wall 157, the left wall 156, the inner wall 158, and the film 152A. A lower end of the third portion 133 is in communication with the upper end of the first portion 131. A front end of the third portion 133 can communicate with a rear end of the second portion 132.

The fourth portion 134 constitutes a portion of the storage chamber 121 positioned upward relative to the third portion 133. The fourth portion 134 is defined by the front wall 157, the upper wall 153, the left wall 156, the inner wall 158, and the film 152A. A lower end of the fourth portion 134 is in communication with an upper end of the third portion 133.

Next, an ink channel 126, the ink needle 102, an air communication portion 124, a pivot member 60, and a liquid-level sensor 61 (an example of a detecting portion) each provided for each of the four storage chambers 121 will be described. Since one ink channel 126, one ink needle 102, one air communication portion 124, one pivot member 60, and one liquid-level sensor 61 are provided for each of the four storage chambers 121, in the present embodiment, four ink channels 126, four ink needles 102, four air communication portions 124, four pivot members 60, and four liquid-level sensors 61 are provided at the tank 103. The four ink channels 126 have substantially the same configuration as one another. The four ink needles 102 have substantially the same configuration as one another. The four air communication portions 124 have substantially the same configuration as one another. The four pivot members 60 have substantially the same configuration as one another. The four liquid-level sensors 61 have substantially the same configuration as one another. Accordingly, one of the four ink channels 126, one of the four ink needles 102, one of the air communication portions 124, one of the pivot members 60, and one of the liquid-level sensors 61, those corresponding to the leftmost storage chamber 121 will be described in detail while description of the remaining three of these components will be omitted.

As illustrated in FIG. 5, the tank body 151 has the four ink channels 126. As described above, the four ink channels 126 are provided in one-to-one correspondence with the four storage chambers 121. Each ink channel 126 is defined by a groove formed at a rear end portion of the tank body 151 and the film 152A welded to the rear surface of the tank body 151. The ink channel 126 has one end (a lower end) in communication with an outlet 122 (see FIG. 8) formed at a lower end of the first portion 131 of the storage chamber 121. The ink channel 126 extends upward from the one end thereof and is bent leftward at an upper end portion of the tank body 151. The ink channel 126 has the other end connected to an ink outlet port 127 (see FIGS. 7 and 8) at a left end portion of the tank body 151. The ink outlet port 127 is connected to corresponding one of the ink tubes 20. Hence, ink stored in the storage chamber 121 is allowed to flow out from the outlet 122 to be supplied to the recording head 21 through corresponding one of the ink channels 126 and corresponding one of the ink tubes 20.

As illustrated in FIG. 7, four projecting portions 200 are provided at the front wall 157 of the tank body 151, projecting frontward therefrom. Specifically, the four projecting portions 200 are each disposed at a portion of the front wall 157 defining the first portion 131 of the storage chamber 121. As illustrated in FIG. 8, one ink needle 102 having hollow configuration is attached to each of the four projecting portions 200. That is, four ink needles 102 are provided. The four ink needles 102 are provided in one-to-one correspondence with the four storage chambers 121. The ink needle 102 has an internal space 117 in communication with the corresponding storage chamber 121 through an inlet 123 (see FIG. 8) formed in the front wall 157 of the tank body 151. The inlet 123 is positioned upward relative to the outlet 122.

As illustrated in FIG. 8, the ink needle 102 protrudes frontward from the front wall 157. The ink needle 102 penetrates a through-hole 105 formed in a rear wall of the case 101 and protrudes into the internal space of the case 101.

In the internal space 117 of the ink needle 102, a valve 114 and a coil spring 115 are accommodated. The valve 114 is movable in the front-rear direction 8 to open and close an opening 116 formed in a protruding tip end of the ink needle 102. The coil spring 115 is configured to urge the valve 114 frontward. Thus, in a state where no external force is applied to the valve 114 (that is, in a state where the ink cartridge 30 is not attached to the case 101), the valve 114 closes the opening 116. Further, in a state where no external force is applied, a front end portion of the valve 114 urged by the coil spring 115 protrudes frontward from the opening 116.

As illustrated in FIGS. 7 and 8, the tank body 151 has the four air communication portions 124. As described above, the four air communication portions 124 are provided in one-to-one correspondence with the four storage chambers 121. Each air communication portion 124 is configured to allow the corresponding storage chamber 121 to communicate with the atmosphere.

The air communication portion 124 includes a communication port 119, a semipermeable membrane 118, a labyrinth channel 120, and an air opening port 129.

The communication port 119 is formed in a portion of the front wall 157 defining the fourth portion 134 of the storage chamber 121. The communication port 119 penetrates the front wall 157 in the front-rear direction 8. As illustrated in FIG. 8, the communication port 119 is positioned at an upper portion of the storage chamber 121.

The semipermeable membrane 118 blocks liquid from flowing therethrough and allows air to pass therethrough. The semipermeable membrane 118 is welded to the front wall 157 (specifically, a rib 171 formed on the front wall 157) so as to cover the communication port 119.

As illustrated in FIG. 7, the labyrinth channel 120 is defined by a front surface 157A of the front wall 157, the rib 111 formed on the front surface 157A, and the film 152B welded to the protruding endface of the rib 111. The labyrinth channel 120 is in the form of a labyrinth and extends from one end thereof to the other end thereof while being bent. The one end of the labyrinth channel 120 is in communication with the communication port 119. The other end of the labyrinth channel 120 is in communication with the air opening port 129. Hence, the storage chamber 121 is open to the atmosphere through the air communication portion 124.

<Pivot Member 60>

As illustrated in FIGS. 5 and 8, the pivot member 60 is disposed in the storage chamber 121. The pivot member 60 is pivotably supported by a support member 62 (an example of a support portion) disposed in the storage chamber 121 so as to be pivotally movable in directions of arrows 58 and 59. The pivot member 60 is disposed in the first portion 131 and the second portion 132 of the storage chamber 121. The support member 62 is disposed in the first portion 131 of the storage chamber 121.

Figure 9C:
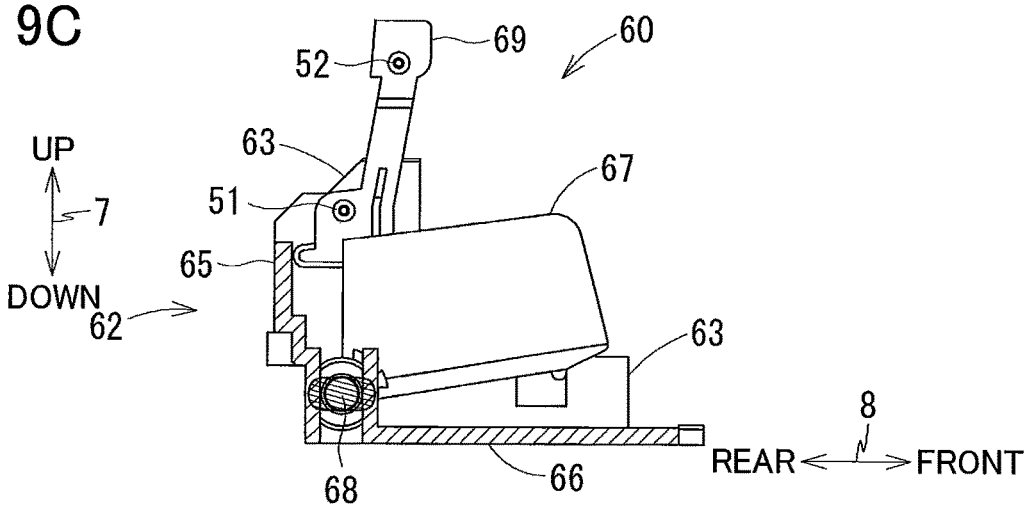
FIG. 9C is a cross-sectional view of the pivot member 60 and the support member 62 according to the embodiment taken along a line C-C in FIG. 9B.

As illustrated in FIGS. 9A to 9C, the support member 62 has a pair of side walls (a right wall 63 and a left wall 64), a rear wall 65, and a bottom wall 66. The right wall 63 has a left surface 63A extending in the up-down direction 7 and the front-rear direction 8. The left wall 64 has a right surface 64A extending in the up-down direction 7 and the front-rear direction 8. The left surface 63A and the right surface 64A are side surfaces of the support member 62 and opposed to each other in the left-right direction 9. The left surface 63A and the right surface 64A are each an example of a first surface. The rear wall 65 connects a rear end of the right wall 63 and a rear end of the left wall 64. The bottom wall 66 connects a lower end of the right wall 63 and a lower end of the left wall 64.

The pivot member 60 is disposed between the right wall 63 and the left wall 64 of the support member 62. The pivot member 60 includes a float 67, a shaft 68, a detected portion 69, two first protrusions 51, and two second protrusions 52.

As illustrated in FIGS. 8, and 9A to 9C, the float 67 constitutes a lower portion of the pivot member 60. In a state where the pivot member 60 is disposed in the storage chamber 121, the float 67 is positioned in the first portion 131. The float 67 is made of a material having a specific gravity smaller than that of ink stored in the storage chamber 121.

The shaft 68 is disposed at a lower end portion of the float 67. In other words, the shaft 68 constitutes a lower end portion of the pivot member 60. The shaft 68 protrudes in the left-right direction 9 (an example of an axial direction) from left and right surfaces of the float 67. The shaft 68 is inserted into holes 72 (see FIG. 9A) each formed in one of the right wall 63 and the left wall 64 of the support member 62. With this configuration, the pivot member 60 is supported by the support member 62 so as to be pivotally movable about an axis of the shaft 68.

The detected portion 69 protrudes substantially upward from the float 67. The detected portion 69 has a base end portion (a lower end portion) positioned in the first portion 131 of the storage chamber 121, and a protruding end portion (an upper end portion) positioned in the second portion 132 of the storage chamber 121. At least the protruding end portion of the detected portion 69 is made of a material that can block or attenuate light emitted from a light emitting portion of the liquid-level sensor 61.

The two first protrusions 51 have the same configuration as each other, and are disposed on the detected portion 69 such that the first protrusions 51 are coaxial with each other. The first protrusions 51 are positioned at the base end portion of the detected portion 69. One of the two first protrusions 51 (i.e. a right first protrusion 51) protrudes in the left-right direction 9 from a right surface of the base end portion of the detected portion 69, while the other of the two first protrusions 51 (i.e. a left first protrusion 51) protrudes in the left-right direction 9 from a left surface of the base end portion of the detected portion 69. In other words, the right first protrusion 51 protrudes rightward from a right surface of the detected portion 69 toward the left surface 63A of the right wall 63, while the left first protrusion 51 protrudes leftward from a left surface of the detected portion 69 toward the right surface 64A of the left wall 64. The first protrusions 51 are each formed in a tapered shape that is tapered toward its protruding end.

A gap is formed between the right first protrusion 51 and the left surface 63A of the right wall 63 in the left-right direction 9. Similarly, a gap is formed between the left first protrusion 51 and the right surface 64A of the left wall 64 in the left-right direction 9.

In a state where a liquid surface (liquid level) of the ink stored in the storage chamber 121 is at a predetermined position P in the up-down direction 7, the first protrusions 51 are at positions in contact with the ink stored in the storage chamber 121. In the present embodiment, the first protrusions 51 are positioned adjacent to the predetermined position P. More specifically, the first protrusions 51 are positioned slightly upward relative to the predetermined position P. In the present embodiment, the predetermined position P is at a height the same as the center of the internal space 117 of the ink needle 102 when viewing the ink needle 102 in the front-rear direction 8. Incidentally, the predetermined position P may be at a height different from that of the center of the internal space 117 of the ink needle 102.

A liquid surface 53 illustrated by dashed lines in FIGS. 8 and 9B denotes a liquid surface of the ink stored in the storage chamber 121 in a state where the liquid surface is at the predetermined position P. In a strict sense, the liquid surface 53 is higher than the predetermined position P at a position adjacent to walls and the like (e.g. the right wall 63 of the support member 62, the left wall 64 of the support member 62, the front wall 157, the film 152A, and the first protrusions 51) due to surface tension acting between the ink and the walls and the like. Therefore, although the first protrusions 51 are positioned upward relative to the predetermined position P, the first protrusions 51 are in contact with the liquid surface of the ink stored in the storage chamber 121 in a state where the liquid surface of the ink stored in the storage chamber 121 is at the predetermined position P.

That is, in a state where the liquid surface of the ink stored in the storage chamber 121 is at the predetermined position P, the first protrusions 51 are at positions upward relative to a part of the liquid surface positioned downstream and upstream in the pivot direction of the pivot member 60 (e.g., downstream in the direction of the arrow 58 and downstream in the direction of the arrow 59), that is, a part of the liquid surface positioned rearward and frontward of the first protrusions 51 and, at the same time, the first protrusions 51 are also at positions in contact with a part of the liquid surface different from the above part.

In other words, in a state where the liquid surface of the ink stored in the storage chambers 121 is at the predetermined position P, the first protrusions 51 are provided at positions upward relative to a part of the liquid surface positioned at the same height as the predetermined position P and also at positions in contact with a part of the liquid surface positioned at a height higher than the predetermined position P due to the surface tension.

The two second protrusions 52 have the same configuration as each other and are disposed on the detected portion 69 such that the second protrusions 52 are coaxial with each other. The second protrusions 52 are positioned at the protruding end portion of the detected portion 69. That is, the second protrusions 52 are positioned upward relative to the first protrusions 51 and separated farther from the shaft 68 than the first protrusions 51 are from the shaft 68.

One of the two second protrusions 52 (i.e. a right second protrusion 52) protrudes in the left-right direction 9 from a right surface of the protruding end portion of the detected portion 69, while the other of the two second protrusions 52 (i.e. a left second protrusion 52) protrudes in the left-right direction 9 from a left surface of the protruding end portion of the detected portion 69. In other words, the right second protrusion 52 protrudes rightward from the right surface of the detected portion 69 toward the left surface 159A of the right side wall 159, while the left second protrusion 52 protrudes leftward from the left surface of the detected portion 69 toward the right surface 159B of the left side wall 159. The second protrusions 52 are each formed in a tapered shape that is tapered toward its protruding end.

A gap is formed between the one of the right second protrusion 52 and the left surface 159A in the left-right direction 9. Similarly, a gap is formed between the right second protrusion 52 and the right surface 159B in the left-right direction 9.

As illustrated in FIG. 9B, the right first protrusion 51 and the left surface 63A define a gap length G1 therebetween in the left-right direction 9, and the left first protrusion 51 and the right surface 64A define the gap length G1 therebetween in the left-right direction 9. Further, as illustrated in FIG. 9B, the right second protrusion 52 and the left surface 159A define a gap length G2 therebetween in the left-right direction 9, and the left second protrusion 52 and the right surface 159B define the gap length G2 therebetween in the left-right direction 9. The gap length G1 is greater than the gap length G2.

In a state where the liquid surface of the ink stored in the storage chamber 121 is higher than the predetermined position P, the pivot member 60 pivotally moves in the direction of the arrow 58 due to buoyancy acting on the float 67. As a result, the detected portion 69 is positioned between the light emitting portion and a light receiving portion of the liquid-level sensor 61 (see FIG. 7).

As the ink stored in the storage chamber 121 is consumed and the liquid surface of the ink stored in the storage chamber 121 is lowered to a position equal to the predetermined position P, the pivot member 60 pivotally moves in the direction of the arrow 59 following the liquid surface of the ink stored in the storage chamber 121. As a result, the detected portion 69 moves to a position retracted from the position between the light emitting portion and the light receiving portion of the liquid-level sensor 61 as denoted by a long dashed double-short dashed line in FIG. 8.

<Liquid-Level Sensor 61>

The liquid-level sensor 61 illustrated in FIG. 7 is configured to optically detect pivotal movement of the pivot member 60, thereby detecting that the liquid surface of the ink stored in the storage chamber 121 has reached the predetermined position P. The liquid-level sensor 61 is mounted on a substrate 198 (see FIG. 8) disposed above the connection wall 160.

In the present embodiment, the liquid-level sensor 61 includes the light emitting portion and the light receiving portion. The light emitting portion and the light receiving portion are arranged spaced apart from each other in the left-right direction 9, with the pair of side walls 159 of the tank 103 interposed between the light emitting portion and the light receiving portion. The light emitting portion is disposed at one of a left side and a right side relative to the pair of side walls 159, while the light receiving portion is disposed at the other of the left side and the right side relative to the pair of side walls 159. A path of light outputted from the light emitting portion is parallel to the left-right direction 9. The protruding end portion of the detected portion 69 of the pivot member 60 can be positioned between the light emitting portion and the light receiving portion. At least a part of the walls defining the storage chamber 121 through which light passes from the light emitting portion to the light receiving portion, that is, at least the pair of side walls 159, is made of a material having translucency.

The liquid-level sensor 61 is configured to output different detection signals depending on whether or not light outputted from the light emitting portion is received by the light receiving portion. For example, the liquid-level sensor 61 is configured to output a low-level signal (a signal whose signal level is lower than a threshold level) to the controller (not illustrated) mounted on the main board (not illustrated) in case that the light receiving portion does not receive the light outputted from the light emitting portion (that is, an intensity of the light received at the light receiving portion is lower than a predetermined intensity). On the other hand, the liquid-level sensor 61 is configured to output a high-level signal (a signal whose signal level is equal to or higher than the threshold level) to the controller in case that the light receiving portion receives the light outputted from the light emitting portion (that is, the intensity of the light received at the light receiving portion is equal to or higher than the predetermined intensity).

In a state where the liquid surface of the ink stored in the storage chamber 121 is higher than the predetermined position P, the protruding end portion of the detected portion 69 of the pivot member 60 is positioned between the light emitting portion and the light receiving portion as denoted by a solid line in FIG. 8. At this time, the light receiving portion does not receive the light outputted from the light emitting portion or receives the light outputted from the light emitting portion and attenuated before reaching the light receiving portion. Hence, the liquid-level sensor 61 outputs the low-level signal to the controller.

On the other hand, in a state where the liquid surface of the ink stored in the storage chamber 121 is equal to or lower than the predetermined position P, the protruding end portion of the detected portion 69 of the pivot member 60 is retracted from the position between the light emitting portion and the light receiving portion as denoted by the long dashed double-short dashed line in FIG. 8. At this time, the light receiving portion receives the light outputted from the light emitting portion or the light outputted from the light emitting portion reaches the light receiving portion without being attenuated. Hence, the liquid-level sensor 61 outputs the high-level signal to the controller.

<Ink Cartridge 30>

Figure 6:
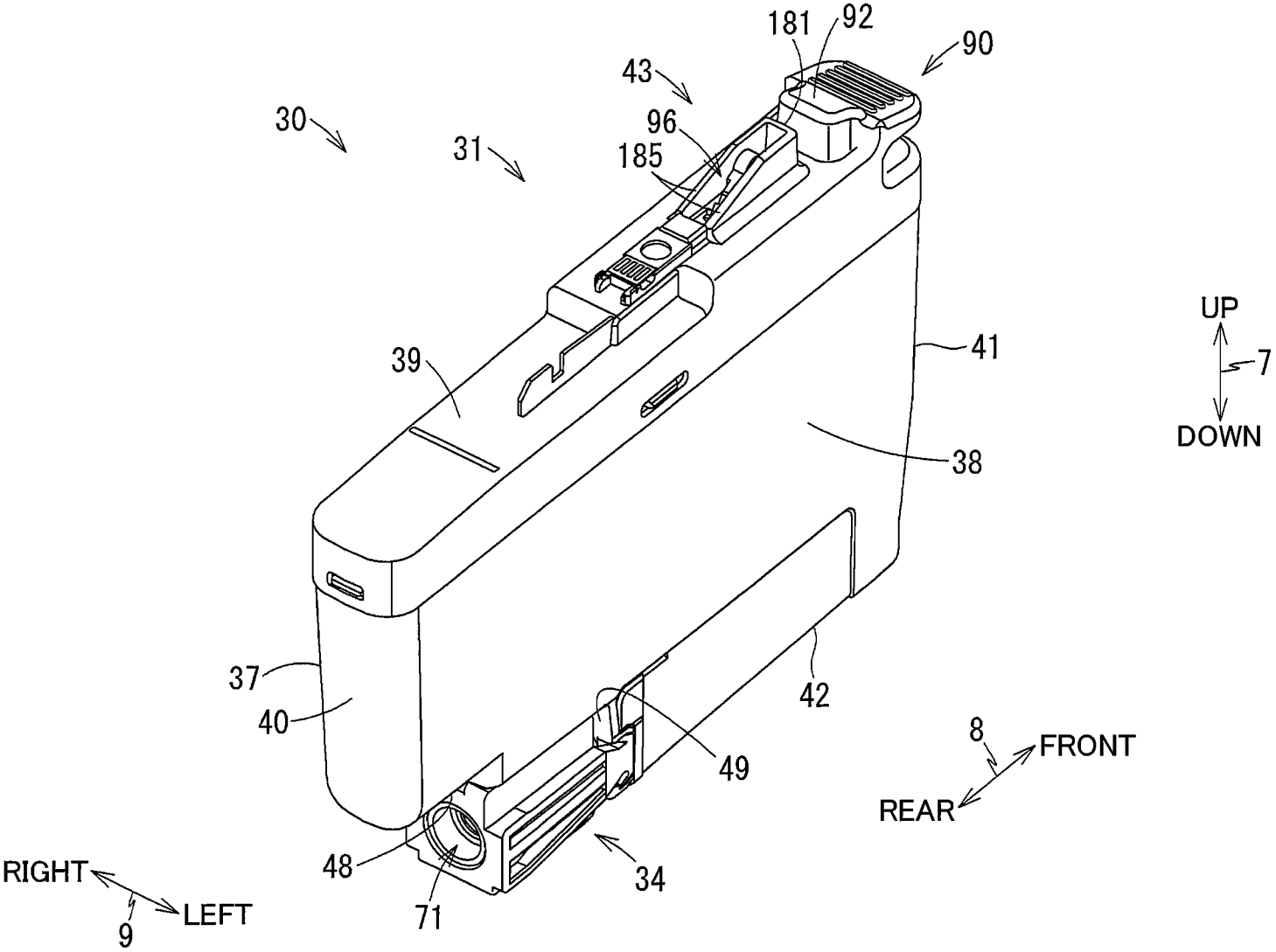
FIG. 6 is a perspective view of an ink cartridge 30 attachable to the case 101 of the multifunction peripheral 10 according to the embodiment as viewed from an upper-rear left side thereof.

The ink cartridge 30 illustrated in FIGS. 6 and 8 is a container for storing ink therein. The posture of the ink cartridge 30 illustrated in FIGS. 6 and 8 is the operable posture of the ink cartridge 30.

As illustrated in FIG. 6, the ink cartridge 30 has a cartridge casing 31 that is substantially rectangular parallelepiped shaped. The cartridge casing 31 has a rear wall 40, a front wall 41, an upper wall 39, a lower wall 42, a right wall 37, and a left wall 38.

The cartridge casing 31 has a generally flattened shape as a whole so that a dimension of the cartridge casing 31 in the left-right direction 9 is small, and a dimension of the cartridge casing 31 in the up-down direction 7 and a dimension of the cartridge casing 31 in the front-rear direction 8 are greater than the dimension of the cartridge casing 31 in the left-right direction 9. In the cartridge casing 31, at least the front wall 41 has translucency that allows liquid levels of ink stored in a storage chamber 32 and a storage chamber 33 (see FIG. 8) to be visually recognized from an outside of the ink cartridge 30.

The cartridge casing 31 further has a sub-lower wall 48. The sub-lower wall 48 is positioned upward relative to the lower wall 42 and extends frontward continuously from a lower end of the rear wall 40. In the present embodiment, a rear end of the sub-lower wall 48 is positioned rearward relative to a rear end of an ink supply portion 34 (described later), and a front end of the sub-lower wall 48 is positioned frontward relative to a rear end of the ink supply portion 34. The lower wall 42 and the sub-lower wall 48 are connected to each other through a stepped surface 49. The ink supply portion 34 extends rearward from the stepped surface 49 at a position downward relative to the sub-lower wall 48 and upward relative to the lower wall 42.

A protruding portion 43 is provided at an outer surface of the upper wall 39. The protruding portion 43 protrudes upward from the outer surface of the upper wall 39 and extends in the front-rear direction 8. The protruding portion 43 has a lock surface 181 facing frontward. The lock surface 181 is positioned upward relative to the upper wall 39. The lock surface 181 is configured to contact the lock shaft 145 in a state where the ink cartridge 30 is attached to the case 101. As illustrated in FIG. 8, the lock surface 181 comes into contact with the lock shaft 145 while pushing the lock shaft 145 frontward, allowing the ink cartridge 30 to be retained in the case 101 against the urging force of the coil spring 78.

As illustrated in FIG. 6, the protruding portion 43 further has a sloped surface 185. The sloped surface 185 is positioned rearward relative to the lock surface 181. During an attachment process of the ink cartridge 30 to the case 101, the lock shaft 145 is guided by the sloped surface 185. As the lock shaft 145 moves along the sloped surface 185, the lock shaft 145 is guided to a position capable of contacting the lock surface 181.

An operation portion 90 is provided on the upper wall 39 at a position frontward relative to the lock surface 181. The operation portion 90 has an operation surface 92. When the operation surface 92 is pressed downward in a state where the ink cartridge 30 is attached to the case 101, the ink cartridge 30 is pivotally moved, thereby moving the lock surface 181 downward. As a result, the lock surface 181 is positioned further downward than the lock shaft 145. This allows the ink cartridge 30 to be removed from the case 101.

As illustrated in FIG. 8, the storage chamber 32, the storage chamber 33, an ink valve chamber 35, and an air channel 36 are provided within the cartridge casing 31. The storage chamber 32, the storage chamber 33, and the ink valve chamber 35 are configured to store ink therein. The air channel 36 provides communication between the atmosphere, and the storage chamber 32, the storage chamber 33 and the ink valve chamber 35. The storage chamber 32 and the storage chamber 33 are in communication with each other through a through-hole (not illustrated). The storage chamber 32 and the air channel 36 are in communication with each other through a through-hole 46. The storage chamber 33 and the ink valve chamber 35 are in communication with each other through a through-hole 99. The through-hole 99 is formed at a lower end of the storage chamber 33.

The air channel 36 is in communication with an outside of the ink cartridge 30 through an air communication port 96. The air communication port 96 is formed in the protruding portion 43. In other words, the storage chamber 32, the storage chamber 33, and the ink valve chamber 35 are in communication with the outside of the ink cartridge 30 through the air channel 36. A portion of the air channel 36 between the through-hole 46 and the air communication port 96 is sealed by a semipermeable membrane 97. The semipermeable membrane 97 blocks liquid from flowing therethrough and allows air to pass therethrough.

As illustrated in FIGS. 6 and 8, the ink supply portion 34 protrudes rearward from the stepped surface 49. The ink supply portion 34 has a cylindrical outer shape. The ink supply portion 34 has an inner space serving as the ink valve chamber 35. The rear end of the ink supply portion 34 is opened to the outside of the ink cartridge 30 through an ink supply port 71. This allows the ink valve chamber 35 to communicate with the outside of the ink cartridge 30. A seal member 76 is provided at a rear end portion of the ink supply portion 34. A front end of the ink valve chamber 35 is in communication with a lower end of the storage chamber 33 through the through-hole 99, as described above.

As illustrated in FIG. 8, a valve 77 and the coil spring 78 are accommodated in the ink valve chamber 35. The valve 77 is configured to move in the front-rear direction 8 to open and close the ink supply port 71 penetrating a center portion of the seal member 76. The coil spring 78 urges the valve 77 rearward. Thus, in a state where no external force is applied to the valve 77, the valve 77 closes the ink supply port 71 formed in the seal member 76.

The seal member 76 is a disk-shaped member having a center portion formed with a through-hole. The seal member 76 is made of an elastic material such as rubber or elastomer, for example. A cylindrical inner peripheral surface defining the through-hole penetrating the center portion of the seal member 76 in the front-rear direction 8 provides the ink supply port 71. The ink supply port 71 has an inner diameter slightly smaller than an outer diameter of the ink needle 102.

<Supply of Ink>

Next, with reference to FIG. 8, ink supply from the ink cartridge 30 to the tank 103 and the recording head 21 will be described.

As the ink cartridge 30 is attached to the case 101 in a state where the valve 77 closes the ink supply port 71 and the valve 114 closes the opening 116 of the ink needle 102, the ink needle 102 enters into the ink supply port 71. In this way, the ink cartridge 30 is connected to the tank 103. At this time, an outer peripheral surface of the ink needle 102 provides liquid-tight contact with an inner peripheral surface of the seal member 76 defining the ink supply port 71 while elastically deforming the seal member 76. As the tip end of the ink needle 102 passes through the seal member 76 and advances into the ink valve chamber 35, the tip end of the ink needle 102 abuts on the valve 77. As the ink cartridge 30 is further inserted into the case 101, the ink needle 102 moves the valve 77 rearward against the urging force of the coil spring 78, thereby opening the ink supply port 71.

While the tip end of the ink needle 102 abuts on the valve 77, the valve 77 abuts on the valve 114 from a front side thereof and pushes the valve 114 rearward. Hence, the valve 114 moves rearward against the urging force of the coil spring 115. This opens the opening 116 of the ink needle 102. As a result, the ink stored in the storage chamber 32 and the storage chamber 33 is allowed to flow into the storage chamber 121 of the tank 103 through the ink valve chamber 35 of the ink supply portion 34, the internal space 117 of the ink needle 102, and the inlet 123.

The storage chamber 32 and the storage chamber 33 of the ink cartridge 30 are open to the atmosphere through the air channel 36. Further, the storage chamber 121 of the tank 103 is open to the atmosphere through the air communication portion 124. Thus, the ink stored in the storage chamber 32 and the storage chamber 33 of the ink cartridge 30 is supplied to the corresponding storage chamber 121 of the tank 103 through the ink valve chamber 35 of the ink supply portion 34, the internal space 117 of the ink needle 102, and the inlet 123 due to hydraulic head difference.

The storage chamber 121 stores the ink flowing therein from the storage chamber 32 and the storage chamber 33. The ink stored in the storage chamber 121 flows out of the storage chambers 121 to flow into the ink tube 20 through the ink channel 126 to be supplied to the recording head 21. That is, the recording head 21 is in communication with the outlet 122 through the ink channel 126.

The ink supply from the ink cartridge 30 to the recording head 21 due to hydraulic head difference is performed until the liquid level of the ink stored in the storage chamber 32, the storage chamber 33, and the ink valve chamber 35 of the ink cartridge 30 becomes equal in height to the liquid level of the ink stored in the storage chamber 121 of the tank 103 in the up-down direction 7.

<Advantageous Effects>

According to the present embodiment, in a state where the liquid surface of the ink stored in the storage chamber 121 is at the predetermined position P, the first protrusions 51 are at positions in contact with the ink stored in the storage chamber 121.

That is, in this state, the first protrusions 51 are in the ink stored in the storage chamber 121. In other words, in the state where the liquid level of the ink stored in the storage chamber 121 is at the predetermined position P, ink existing between the right first protrusion 51 and the left surface 63A and ink existing between the left first protrusion 51 and the right surface 64A are in fluid communication with ink existing in a remaining portion of the storage chamber 121 (i.e. a portion of the storage chamber 121 other than a portion between the right first protrusion 51 and the left surface 63A and between a portion the left first protrusion 51 and the right surface 64A).

That is, in the above state, it is not the case that ink remains only between the right first protrusion 51 and the left surface 63A and between the left first protrusion 51 and the right surface 64A. Therefore, surface tension acting on a liquid surface of ink and directing in the left-right direction 9 (i.e. an axial direction of the shaft 68) does not generate at positions between the right first protrusion 51 and the left surface 63A and between the left first protrusion 51 and the right surface 64A. This prevents the first protrusions 51 from adhering to the left surface 63A and the right surface 64A due to surface tension directing in the axial direction and acting on the liquid surface of the ink remaining between the right first protrusion 51 and the left surface 63A and between the left first protrusion 51 and the right surface 64A while ink is retained between the right first protrusion 51 and the left surface 63A and between the left first protrusion 51 and the right surface 64A. As a result, the pivotal movement of the pivot member 60 can be suppressed from being hindered.

Further, according to the present embodiment, the pivot member 60 includes the first protrusions 51. Hence, displacement of the pivot member 60 in the axial direction can be reduced.

Further, according to the present embodiment, in the state where the liquid surface of the ink stored in the storage chamber 121 is at the predetermined position P, the first protrusions 51 can be at positions distant from the shaft 68 while being maintained at positions in contact with the ink stored in the storage chamber 121. As a result, displacement of the pivot member 60 in the axial direction can further be reduced.

Further, according to the present embodiment, the first protrusions 51 are positioned adjacent to the predetermined position P and upward relative to a part of the liquid surface of the ink stored in the storage chamber 121 in a state where the liquid surface of the ink stored in the storage chamber 121 is at the predetermined position P. This allows the part of the liquid surface of the ink at the predetermined position P around the first protrusions 51 to be raised to the position of the first protrusions 51 by surface tension directing in an upward direction and acting between the liquid surface and the first protrusions 51. As a result, the first protrusions 51 can contact the raised liquid surface. Accordingly, the first protrusions 51 can smoothly pivotally move the pivot member 60 by utilizing this surface tension.

If a part of the pivot member 60 positioned farther from the shaft 68 than the first protrusions 51 are from the shaft 68 is out of contact with the ink stored in the storage chamber 121 in a state where the liquid surface of the ink stored in the storage chamber 121 is at the predetermined position P, this part may adhere to a surface in the storage chamber 121 by surface tension directing in the axial direction and acting on the liquid surface of the ink remaining between the part and the surface in the storage chamber 121 to hinder the pivotal movement of the pivot member 60.

To cope with this problem, according to the present embodiment, the pivot member 60 further includes the second protrusions 52 at positions farther from the shaft 68 than the first protrusions 51 are from the shaft 68. Hence, even if the part of the pivot member 60 positioned farther from the shaft 68 than the first protrusions 51 are from the shaft 68 adheres to a surface in the storage chamber 121 (e.g., the left surface 159A or the right surface 159B), it is either one of the two second protrusions 52 that adheres to the left surface 159A or the right surface 159B. This allows an area of adhesion between the pivot member 60 and the left and right surfaces 159A and 159B to be reduced. Accordingly, the pivotal movement of the pivot member 60 can be suppressed from being hindered.

Further, according to the present embodiment, the pivot member 60 includes the second protrusions 52. Hence, displacement of the pivot member 60 in the axial direction can be reduced.

Further, according to the present embodiment, in the state where the liquid surface of the ink stored in the storage chamber 121 is at the predetermined position P, the first protrusions 51 are in the ink stored in the storage chamber 121, while the second protrusions 52 are out of the ink stored in the storage chamber 121. In addition, according to the present embodiment, the gap length G1 between the right first protrusion 51 and the left surface 63A or between the left first protrusion 51 and the right surface 64A is greater than the gap length G2 between the right second protrusion 52 and the left surface 159A or the left second protrusion 52 and the right surface 159B. Hence, when the pivot member 60 is displaced in the axial direction, the right second protrusion 52 contacts the left surface 159A before the right first protrusion 51 contacts the left surface 63A or the left second protrusion 52 contacts the right surface 159B before the left first protrusion 51 contacts the right surface 64A. Thus, a gap between the right first protrusion 51 and the left surface 63A and a gap between the left first protrusion 51 and the right surface 64A are maintained. As a result, generation of the surface tension directing in the axial direction and acting on the liquid surface of the ink between the right first protrusion 51 and the left surface 63A and between the left first protrusion 51 and the right surface 64A can be suppressed, thereby fulfilling the function of the first protrusions 51 that smoothly pivotally moves the pivot member 60.

Further, according to the present embodiment, the float 67 is positioned in the first portion 131. Thus, the float 67 can be formed large in size. This can improve accuracy in pivotal movement of the pivot member 60.

<Modifications>

In the above-described embodiment, each of the first protrusions 51 is positioned adjacent to the predetermined position P and slightly upward relative to the predetermined position P. However, the position of the first protrusion 51 in the up-down direction 7 is not limited to the position slightly upward relative to the predetermined position P.

For example, the first protrusion 51 may be positioned adjacent to the predetermined position P and slightly downward relative to the predetermined position P. In this case, in a state where the liquid surface of the ink stored in the storage chamber 121 is at the predetermined position P, the first protrusion 51 is in contact with the ink stored in the storage chamber 121 regardless of the presence and absence of the surface tension acting between the first protrusion 51 and the ink.

Further, for example, the first protrusion 51 may be positioned adjacent to the predetermined position P and at a height the same as the predetermined position P. In this case, in a state where the liquid surface of the ink stored in the storage chamber 121 is at the predetermined position P, the first protrusion 51 is in contact with the liquid surface of the ink stored in the storage chamber 121 regardless of the presence and absence of the surface tension acting between the first protrusion 51 and the ink.

According to the present modification, in a state where the liquid surface of the ink stored in the storage chamber 121 is at the predetermined position P, the first protrusion 51 is at a position in contact with the liquid surface of the ink. Thus, surface tension vertically moving the first protrusion 51 acts between the first protrusion 51 and the liquid surface. Thus, the first protrusion 51 can smoothly pivotally move the pivot member 60 by utilizing this surface tension.

In the above-described embodiment, the first protrusion 51 is positioned adjacent to the predetermined position P. However, in a state where the liquid surface of the ink stored in the storage chamber 121 is at the predetermined position P, the first protrusion 51 need not necessarily be positioned adjacent to the predetermined position P in case that the first protrusion 51 is at a position in contact with the ink stored in the storage chamber 121. For example, the first protrusion 51 may be disposed at a position offset significantly downward from the predetermined position P, such as a position substantially the same height as the shaft 68.

In the above-described embodiment, the first protrusion 51 protrudes from the detected portion 69. However, the first protrusion 51 may protrude from the float 67.

In the above-described embodiment, the pivot member 60 includes the first protrusion 51 and the second protrusion 52. However, the pivot member 60 need not necessarily include the second protrusion 52. That is, of the first protrusion 51 and the second protrusion 52, the pivot member 60 may include at least the first protrusion 51.

In the above-described embodiment, the gap length G1 defined between the right first protrusion 51 and the left surface 63A and also defined between the left first protrusion 51 and the right surface 64A in the left-right direction 9 is greater than the gap length G2 defined between the right second protrusion 52 and the left surface 159A and also defined between the left second protrusion 52 and the right surface 159B in the left-right direction 9. However, the gap length G1 may be equal to or smaller than the gap length G2.

In the above-described embodiment, the detected portion 69 protrudes substantially upward from the float 67. However, the protruding direction of the detected portion 69 is not limited to the substantially upward direction. For example, the detected portion 69 may protrude frontward from the float 67. In this case, the second protrusion 52 is at a position farther from the shaft 68 than the first protrusion 51 is from the shaft 68 and at a height substantially the same as that of the first protrusion 51. That is, in this case, the second protrusion 52 is not positioned upward relative to the first protrusion 51.

In the above-described embodiment, the detected portion 69 extends substantially upward from the float 67. That is, the detected portion 69 extends in a direction perpendicular to the left-right direction 9 coincident with the axial direction of the pivot member 60 in the above-described embodiment. However, the extending direction of the detected portion 69 is not limited to the direction perpendicular to the axial direction of the pivot member 60. The extending direction of the detected portion 69 may be at least a direction crossing the axial direction of the pivot member 60.

In the above-described embodiment, the shaft 68 constitutes the lower end portion of the pivot member 60. However, the shaft 68 may be provided at a portion of the pivot member 60 other than the lower end portion of the pivot member 60. The shaft 68 may be positioned at a center portion of the pivot member 60 in the up-down direction 7.

In the above-described embodiment, the left surface 63A of the right wall 63 and the right surface 64A of the left wall 64 each extend in the up-down direction 7 and the front-rear direction 8. That is, the left surface 63A and the right surface 64A are each a surface perpendicular to the left-right direction 9 coincident with the axial direction of the pivot member 60 in the above-described embodiment. However, the left surface 63A and the right surface 64A are each not limited to a surface perpendicular to the axial direction of the pivot member 60. The left surface 63A and the right surface 64A may each be at least a surface crossing the axial direction of the pivot member 60.

In the above-described embodiment, the left surface 159A of the right side wall 159 extends in the up-down direction 7 and the front-rear direction 8. Further, the right surface 159B of the left side wall 159 extends in the up-down direction 7 and the front-rear direction 8. That is, the left surface 159A and the right surface 159B are each a surface perpendicular to the left-right direction 9 coincident with the axial direction of the pivot member 60 in the above-described embodiment. However, the left surface 159A and the right surface 159B are each not limited to a surface perpendicular to the axial direction of the pivot member 60. The left surface 159A and the right surface 159B may each be at least a surface crossing the axial direction of the pivot member 60.

In the above-described embodiment, the pivot member 60 is supported by the support member 62. However, the pivot member 60 may be supported by a member other than the support member 62, such as the lower wall 154 of the tank body 151 of the tank 103.

In the above-described embodiment, the first protrusions 51 protrude toward the right wall 63 and the left wall 64 of the support member 62, respectively. However, the first protrusions 51 may protrude toward walls other than the right wall 63 and the left wall 64. For example, the right first protrusion 51 may protrude from the right surface of the detected portion 69 toward one of the walls defining the storage chamber 121 that is positioned rightward of the detected portion 69, while the left first protrusion 51 may protrude from the left surface of the detected portion 69 toward another one of the walls defining the storage chamber 121 that is positioned leftward of the detected portion 69. In this case, surfaces of the walls opposing the first protrusions 51 are each another example of the first surface. Incidentally, the predetermined position P of this modification may be at a position offset significantly upward from the predetermined position P of the above-described embodiment. Specifically, even in this modification, each of the first protrusions 51 may be positioned adjacent to the predetermined position P and slightly upward relative to the predetermined position P.

In the above-described embodiment, the second protrusions 52 protrude toward the pair of side walls 159, respectively. However, the second protrusions 52 may protrude toward walls other than the pair of side walls 159. For example, the right second protrusion 52 may protrude rightward from the right surface of the detected portion 69 toward the left surface 63A of the right wall 63 of the support member 62, while the left second protrusion 52 may protrude leftward from the left surface of the detected portion 69 toward the right surface 64A of the left wall 64 of the support member 62. In this case, the left surface 63A and the right surface 64A are each another example of the second surface.

In the above-described embodiment, the number of the ink cartridges 30 that can be attached to the multifunction peripheral 10 is four. However, the number of the ink cartridges 30 that can be attached to the multifunction peripheral 10 is not limited to four but may be any number. In this case, the multifunction peripheral 10 may be configured such that the number of spaces partitioned by the plates 104 in the case 101, the number of the storage chambers 121 of the tank 103, and the like are equal to the number of the ink cartridges 30 to be attached to the multifunction peripheral 10.

In the above-described embodiment, the multifunction peripheral 10 is configured such that the ink cartridges 30 can be detachably attached. By replacing the attached ink cartridge 30 with a new cartridge, the multifunction peripheral 10 (the tank 103 and the recording head 21) is replenished with ink. However, the multifunction peripheral 10 need not necessarily be provided with the ink cartridge 30. In this case, the tank 103 has an injection port at its upper portion. The injection port provides communication between the storage chamber 121 and the outside of the tank 103. When an amount of the ink stored in the storage chamber 121 is reduced, new ink is injected through the injection port. In this case, the tank 103 may have a capacity preferably greater than that in the above-described embodiment.

In the above-described embodiment, the pivot member 60 is disposed in the storage chamber 121 of the tank 103. However, the pivot member 60 may be disposed inside the ink cartridge 30 (e.g., the storage chamber 32). In this case, the multifunction peripheral 10 need not be provided with the tank 103. When the multifunction peripheral 10 is not provided with the tank 103, one end of the ink tube 20 is connected to the case 101, and the other end of the ink tubes 20 is connected to the recording head 21. Ink stored in the ink cartridge 30 attached to the case 101 is supplied to the recording head 21 through the ink tube 20.

In the above-described embodiment, ink serves as an example of liquid. However, instead of ink, a pretreatment liquid that is ejected onto a recording sheet prior to the ink during an image forming operation may be used as liquid. Alternatively, water to be sprayed in the vicinity of the nozzles 29 of the recording head 21 for preventing the nozzles 29 from drying, and the like may be used as liquid.

While the description has been made in detail with reference to the embodiments thereof, it would be apparent to those skilled in the art that many modifications and variations may be made therein without departing from the scope of the disclosure.

What is claimed is:

1. An inkjet recording apparatus comprising:

a tank having a storage chamber configured to store a liquid therein;

a recording portion including a recording head and configured to eject the liquid supplied from the storage chamber;

a pivot member disposed in the storage chamber, the pivot member including a shaft, the pivot member being configured to pivotally move about an axis of the shaft extending in an axial direction in a case where a level of a liquid surface of the liquid stored in the storage chamber becomes equal to a predetermined liquid level, the pivot member comprising:

a float having a specific gravity smaller than that of the liquid stored in the storage chamber;

a detected portion extending from the float in a direction crossing the axial direction, the detected portion being configured to be detected by the detecting portion; and a first protrusion;

a detecting portion configured to detect pivotal movement of the pivot member; and a first surface disposed in the storage chamber and crossing the axial direction, the first protrusion protruding in the axial direction toward the first surface, the first protrusion and the first surface providing a gap therebetween in the axial direction, the first protrusion being at a position in contact with the liquid stored in the storage chamber in a state where the level of the liquid surface of the liquid stored in the storage chamber is at the predetermined liquid level;

wherein the first protrusion is positioned at a position apart from the shaft in a direction crossing the axial direction.

2. The inkjet recording apparatus according to claim 1, wherein the axis is positioned at a lower end portion of the pivot member, and wherein the first protrusion is positioned adjacent to the predetermined liquid level in an up-down direction.

3. The inkjet recording apparatus according to claim 1, wherein the first protrusion is at a position in contact with the liquid surface of the liquid stored in the storage chamber in the state where the level of the liquid surface of the liquid stored in the storage chamber is at the predetermined liquid level.

4. The inkjet recording apparatus according to claim 3, wherein the pivot member is configured to pivotally move about the axis in a pivot direction, and wherein the first protrusion is at a position upward relative to a part of the liquid surface of the liquid stored in the storage chamber in the state where the level of the liquid surface of the liquid stored in the storage chamber is at the predetermined liquid level, the part being positioned offset from the first protrusion in the pivot direction.

5. The inkjet recording apparatus according to claim 1, further comprising a second surface disposed in the storage chamber, the second surface crossing the axial direction, wherein the pivot member further comprises a second protrusion protruding in the axial direction toward the second surface at a position farther from the axis than the first protrusion is from the axis, a gap being provided between the second protrusion and the second surface in the axial direction.

6. The inkjet recording apparatus according to claim 5, wherein the second protrusion is positioned upward relative to the predetermined liquid level, and wherein the gap between the first protrusion and the first surface is greater than the gap between the second protrusion and the second surface.

7. The inkjet recording apparatus according to claim 6, wherein the second surface is a surface defining the storage chamber.

8. The inkjet recording apparatus according to claim 5, wherein the second protrusion protruding from the detected portion in the axial direction.

9. The inkjet recording apparatus according to claim 1, further comprising a support portion positioned in the storage chamber and pivotably movably supporting the pivot member, wherein the first surface is a side surface of the support portion.

10. The inkjet recording apparatus according to claim 1, wherein the storage chamber comprises:

a first portion; and a second portion positioned upward relative to the first portion and having a capacity smaller than that of the first portion, and wherein the float is positioned in the first portion.

11. The inkjet recording apparatus according to claim 1, further comprising a cartridge configured to store liquid therein and connectable to the tank, wherein the storage chamber is configured to store liquid flowing from the cartridge connected to the tank.

12. The inkjet recording apparatus according to claim 1, wherein the first protrusion protruding from the detected portion in the axial direction.

* * * * *